United States Patent [19]

Ransom

[11] Patent Number: 5,067,268

[45] Date of Patent: Nov. 26, 1991

[54] RIFLE REST

[76] Inventor: Charles R. Ransom, 134 S. Horizon Cr., Prescott, Ariz. 86303

[21] Appl. No.: 572,703

[22] Filed: Aug. 27, 1990

[51] Int. Cl.[5] ..... F41A 23/14

[52] U.S. Cl. ..... 42/94; 89/37.110

[58] Field of Search ..... 42/94; 73/167; 89/37.03, 37.04, 37.11, 40.06; 248/178, 179, 186, 405, 406, 406.1, 406.2, 413, 414

[56] References Cited

U.S. PATENT DOCUMENTS 1,304,591 5/1919 North ..... 89/37.03

OTHER PUBLICATIONS

The American Rifleman, Apr. 1957, pp. 17–19.

*Primary Examiner*—Stephen C. Bentley

*Attorney, Agent, or Firm*—Cahill, Sutton & Thomas

[57] ABSTRACT

A rifle rest with stop means for respectively releasing and stopping movement of both coarse and fine elevation adjustments and shafts and handles for manipulating the stops. The shafts and handles of the elevating mechanism stops which are outboard of the hub region of the rest are fabricated from hollow tubing to reduce their mass. An adjustable bias in the releasable stop for the coarse elevation adjustment is provided to control manipulation of this adjustment.

5 Claims, 2 Drawing Sheets

RIFLE REST

TECHNICAL FIELD

This invention is concerned with rests used to support the fore-end of rifles for accurate range shooting.

BACKGROUND ART

It is customary to build into rifle rests a mechanism for adjusting the elevation of the sandbag cradle on which the fore-end of the rifle rests. The elevating mechanism usually comprises two stages. One stage, for coarse elevation adjustment, is employed to initially aim the rifle at the target, generally. The other stage, for fine elevation adjustment, is employed to aim the rifle at the target bull as the shooter sights the target, usually through a telescopic sight. Releasable stops are usually provided on the rest for locking both stages of the elevating mechanism when the rifle has been sighted in.

Rests of the type this invention is concerned with are used by competitive range shooters seeking to shoot with extreme accuracy. For example, it is not at all unusual for such a shooter to create a shot pattern of five successive shots displaced by but a fraction of an inch at a target distance of 200 yards or more.

These rests must be stable and steady so as to be virtually unaffected by normal rifle recoil. Thus, it has been the practice to construct the rests from rather massive and heavy components throughout in an effort to provide the steadiness required for accurate shooting.

The practice of employing all high mass components can be counterproductive in some instances. For example, the shafts and handles for manipulating the elevating mechanism stops generally extend radially outwardly from the hub region of the rest and are supported only at their inner ends. For ease and convenience in manipulation by the shooter, these shafts are several inches long to present the handles where they can be readily grasped. As such, the shafts and handles can exhibit cantilever beam behavior and may vibrate when excited by rifle recoil. Such vibration, in turn, has a tendency to upset the steadiness of the rest, which, ideally, should remain rock-solid still.

DISCLOSURE OF THE INVENTION

In accordance with this invention, those portions of the shafts and handles of the elevating mechanism stops which are outward of the hub region of the rest are fabricated from hollow tubing to reduce their mass. The resulting stiffness-to-weight ratio for these components reduces the likelihood of their being excited to vibrate by recoil shocks. And, further, to the extent that these hollow tubular components do commence to vibrate, their low mass is incapable of imparting any movement to the other massive components of the rest.

The invention further contemplates the provision of an adjustable bias in the releasable stop for the first, or coarse, stage elevation adjustment to better control manipulation of this adjustment.

BRIEF DESCRIPTION OF THE DRAWINGS

The invention is described in greater detail hereinafter by reference to the accompanying drawings, wherein.

BEST MODES FOR CARRYING OUT THE INVENTION

Figure 1:
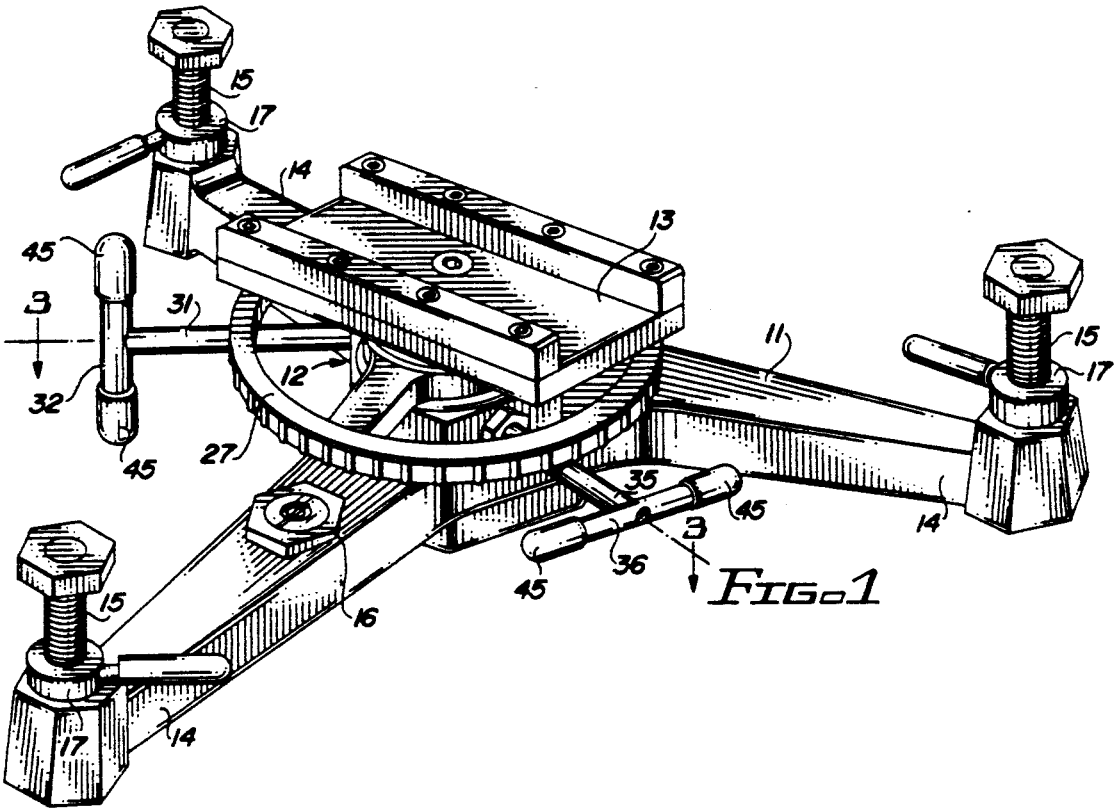
FIG. 1 is a perspective view from above of a rifle rest embodying this invention.

Referring particularly to FIG. 1, the reference numeral 11 designates the tripod base of the rifle rest of this invention. Base 11 has a hub region 12 containing an elevating mechanism (described hereinafter) for raising and lowering a sandbag cradle 13.

In use, the rifle rest base 11 is placed on a solid surface with a sandbag (not shown) in place on cradle 13. The shooter rests the fore-end of his rifle on the sandbag and adjusts the rest to aim the rifle at a target.

Each leg 14 of base 11 has a leveling screw 15 at the distal end thereof for leveling the base according to a circular sight level 16. When the base has been leveled, that condition is maintained by locking each leveling screw in position by means of the locking nuts 17.

Figure 2:
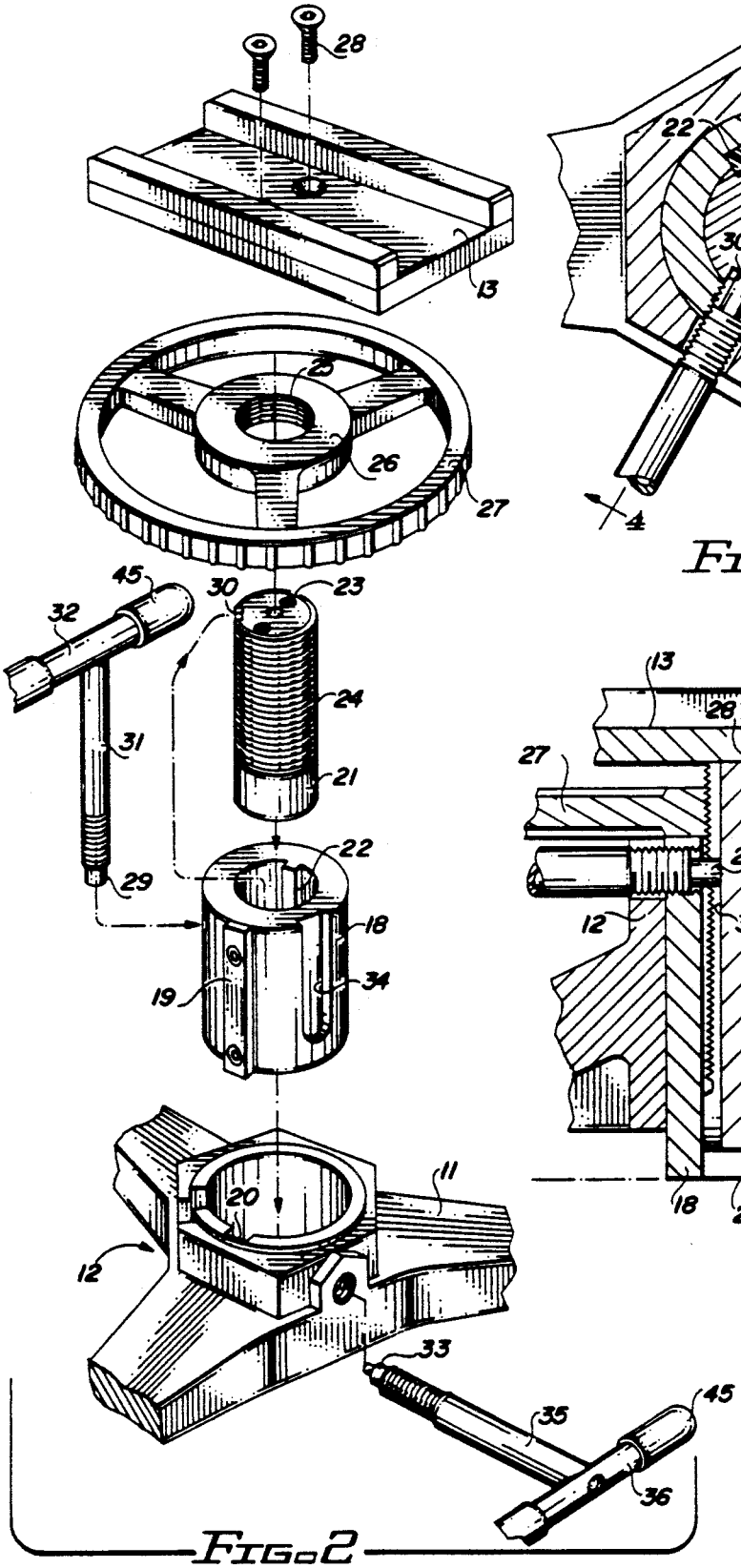
FIG. 2 is an exploded perspective view of the hub region of the rest illustrating the components of the elevating mechanism of the rest.
Figure 3:
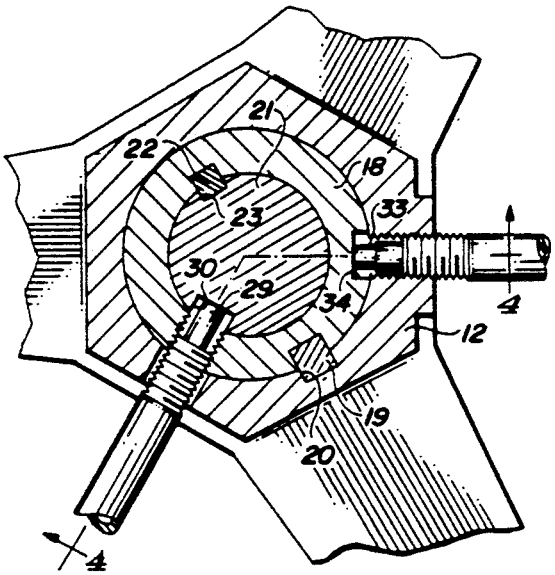
FIG. 3 is a horizontal sectional view through the hub region of the rest.
Figure 4:
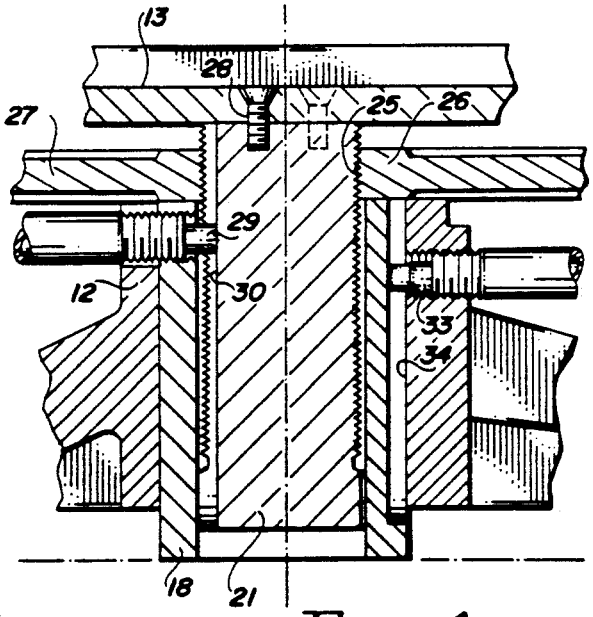
FIG. 4 is a vertical sectional view through the hub region of the mast, taken as indicated by line 4 in FIG. 3.

Housed within the hub 12 of base 11 is a two-stage elevating mechanism best illustrated in FIGS. 2–4. Slidably received for vertical up and down movement in hub 12 is a cylindrical collar 18. A key 19 affixed to the outer surface of collar 18 rides in a keyway 20 in the inner surface of hub 12 to prevent rotation of the collar in the hub.

The elevating mechanism further comprises a cylindrical post 21 slidably received inside collar 18. A key 22 on the inner surface of collar 18 slides in a keyway 23 cut in the outer surface of post 21. This key arrangement prevents relative rotational movement of the post 21 and the collar 18 but permits the post to slide up and down inside the collar. Post 21 is provided with threads 24 throughout a substantial portion of its length. Post threads 24 mate with threads 25 on the inner surface of the hub portion 26 of a spoked hand wheel 27.

Connection between the elevating mechanism and cradle 13 is established by screws 28 passing through the cradle and threaded into the upper end of post 21.

It can be appreciated that with the hub 26 of hand wheel 27 resting atop collar 18, rotation of the hand wheel raises and lowers post 21 by virtue of the threaded connection between the hand wheel and the post. This connection provides the fine elevation adjustment stage of the elevating mechanism.

Pulling upwardly on the cradle 18 or the hand wheel 27 results in the collar sliding upwardly within base hub 12. This is the course elevational adjustment stage of the elevating mechanism. The elevating adjustment mechanism is completed by means for stopping and locking the post 21 and the collar 18 in positions to which they are adjusted by the shooter. The stop means for the fine adjustment is the stop member 29 threadably received within collar 18 for frictional engagement with the bottom of a vertical kerf 30 cut in the surface of post 21. Stop member 29 is manipulated by means of a shaft 31 having a transverse handle 32 secured to the end thereof. Turning handle 32 in one direction drives stop member 29 into tight frictional engagement with post 21 to lock the post in position relative to collar 18. Turning handle 32 in the opposite direction moves stop member 29 out of engagement with the bottom of kerf 30, freeing post 18 to be moved relative to collar 18 by turning hand wheel 27.

The stop means for the course adjustment is another stop member 33, threadably received in base hub 12 for frictional engagement with the bottom of a vertical kerf 34 cut in the surface of collar 18. Stop member 33 is manipulated by means of a shaft 35 having a transverse handle 36 secured to the end thereof.

It will be noted that kerf 30 in post 21 terminates above the lower end of the post (see FIG. 4). Similarly, the kerf 34 in collar 18 terminates a short distance above the lower end of the collar (see FIGS. 2 and 4). With this arrangement, with stop members 29 and 33 loosened from the post 21 and collar 18, respectively, but still projecting into the kerfs 30 and 34, both the post 21 and collar 18 are prevented from being accidentally withdrawn upwardly from the base hub 12. This is because the stop members 29 and 33 engage the ends of their respective kerfs 30 and 34. Because the post 21 and collar 18 are precision machined parts, it is important that they not be subjected to abrasion or other abuse. Hence, they should not be accidentally removable.

The termination of kerf 30 above the lower end of post 21 enables the stop member 29 to lift the collar 18 for coarse adjustment of the elevating mechanism when the post is raised and the stop member encounters the end of post kerf 30.

Figure 6:
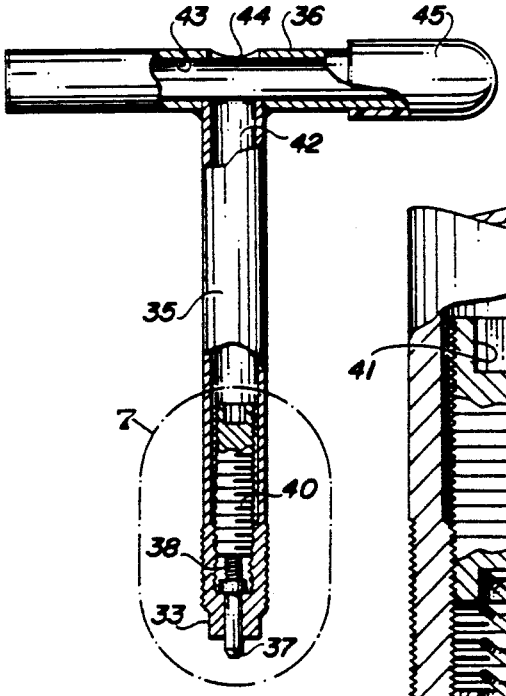
FIG. 6 is a plan view, partially in section, of a collar lock employed in the rest.
Figure 7:
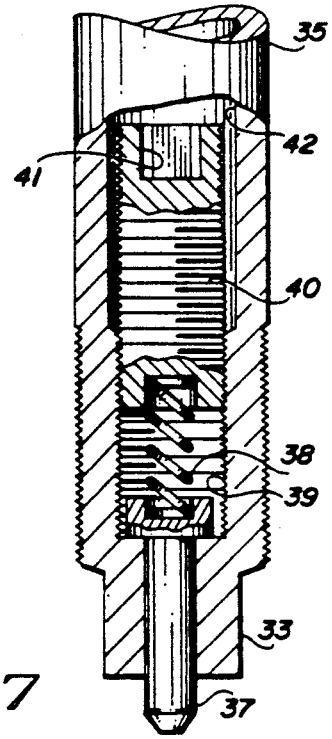
FIG. 7 is an enlarged view of that region of the collar lock encircled by line 7 in FIG. 6.

The rifle rest of this invention is also preferably equipped with means to permit controlled lowering of the collar 18 within base hub 12 so that it does not freefall and slam into the base when stop member 33 is loosened. This control means takes the form of a movably pin 37 projecting axially from the end of stop member 33 (see FIGS. 6 and 7). The pin 37 is biased outwardly of the stop member 33 by means of a helical compression spring 38 contained in a threaded chamber 39 within stop member 33. The compression of spring 38 is adjusted by means of a set screw 40 received in chamber 39. Access to the manipulating head 41 of set screw 40 is through the hollow bore 42 of shaft 35, the hollow bore 43 in handle 36 and a hole 44 in the handle.

When stop member 33 is backed off from contact with the bottom of kerf 34 and collar 18, at least initially pin 38 remains in contact with the collar, being biased against it by spring 38. The compression spring 38 is preferably adjusted by set screw 40 to force pin 37 into sufficient frictional contact with collar 18 to allow the latter and the other components carried thereby to slide slowly downwardly within hub 12.

Figure 5:
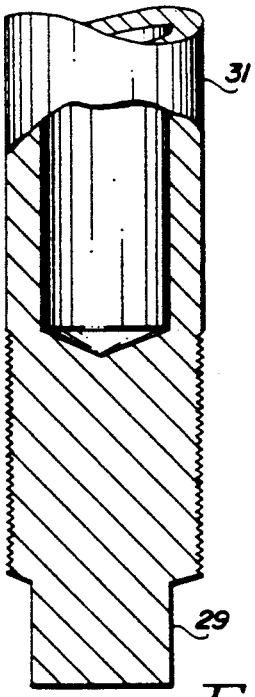
FIG. 5 is an enlarged fragmentary view in partial section of one end of a post lock employed in the rest.

As mentioned above, shaft 35 and handle 43 have hollow bores 42 and 43 respectively. In other words, these components are made of hollow tubing. The same is true of the shaft 31 and handle 32 for manipulating stop 29 (see FIG. 5). Utilizing this construction, the shafts 31 and 35 can be made very long to place handles 32 and 36 at readily accessible locations out from under the cradle 13 and hand wheel 27. Even though this results in the use of fairly lengthy shafts, the rigidity of the shafts 31 and 35, coupled with the low mass of the hollow shafts and handles 32 and 36, reduces any tendency for these members to interfere with adjustment of the rest by vibrating when subjected to recoil forces.

If desired, the open ends of the handles 32 and 36 can be closed with light weight plastic caps 45.

From the foregoing, it should be apparent that this invention provides a highly reliable and accurate rifle rest for accurate range shooting.

What is claimed is:

1. A rifle rest comprising a base, a cradle, and a mechanism for permitting adjustment of the elevation of the cradle with respect to said base, said mechanism comprising a hub formed in said base, a collar slidably received in said hub, means connecting said collar to said cradle, means for locking said collar in position in said hub, said locking means comprising a locking member, a shaft having one end connected to said member and extending radially outwardly from said collar, the other end of said shaft having a handle thereon, the portions of said shaft and said handle which are spaced outwardly of said hub being fabricated substantially entirely of tubular material.

2. The rifle rest of claim 1 further characterized in that said stop member has a pin member slidably received therein and a spring biasing said pin member axially outwardly of the shaft.

3. The rifle rest of claim 1 further characterized in that said means connecting said collar to said cradle comprises a threaded post axially slidably in said collar and a wheel threaded onto said post and resting against said collar, the arrangement being such that rotation of said wheel adjusts the elevation of said post and said cradle with respect to said collar, and means for locking said post in position in said collar.

4. The rifle rest of claim 3 further characterized in that said means for locking said post in position on said collar is a second locking member threadably received in said collar, a second shaft connected to said second locking member, and a second handle connected to said second shaft, those portions of said second shaft and said second handle which are spaced outwardly from said collar being fabricated essentially entirely of tubular material.

5. The rifle rest of claim 4 further characterized in that said post is keyed to said collar and said collar is keyed to said hub to prevent rotation of the post and the collar about their axes.

* * * * *